US005756937A

United States Patent [19]

Gleadall

[11] Patent Number: 5,756,937

[45] Date of Patent: May 26, 1998

[54] REMOVABLE COVER FOR WIRE WRAP CONNECTORS

[75] Inventor: Wilfred L. Gleadall, Leesburg, Va.

[73] Assignee: Hubbell Incorporated, Orange, Conn.

[21] Appl. No.: 754,928

[22] Filed: Nov. 25, 1996

[51] Int. Cl.[6] ..... H01B 17/00

[52] U.S. Cl. ..... 174/138 F; 439/567; 439/135; D13/156

[58] Field of Search ..... 439/135, 149, 439/940, 567; 174/138 F, 135, 137 R, 136, 138 G; D13/156, 120; 361/807, 808, 809

[56] References Cited

U.S. PATENT DOCUMENTS

| | | | |
|---|---|---|---|
| 4,197,945 | 4/1980 | Sherwood | 206/706 |
| 4,674,910 | 6/1987 | Hayashi | 403/408.1 |
| 4,808,115 | 2/1989 | Norton et al. | 439/79 |
| 5,128,834 | 7/1992 | Kaschke | 361/807 |
| 5,261,828 | 11/1993 | Kandybowski | 439/79 |
| 5,361,492 | 11/1994 | Miyazawa | 29/879 |
| 5,488,539 | 1/1996 | Testa et al. | 361/720 |
| 5,579,212 | 11/1996 | Albano et al. | 361/820 |

*Primary Examiner*—Kristine L. Kincaid
*Assistant Examiner*—Kamand Cuneo
*Attorney, Agent, or Firm*—Jerry M. Presson; Leopold Presser

[57] ABSTRACT

A cover structure which protects the contact pins of connectors which are installed, for example, in a motherboard of a mother circuit panel. More particularly, a removable protective cover for wire wrap pins which are installed in the mother board prevents these pins from bending and electrically shorting together and wherein the removability of the protective cover facilitates ready access to the wire wrap pins to enable installation of additional wire wraps in the field.

8 Claims, 2 Drawing Sheets

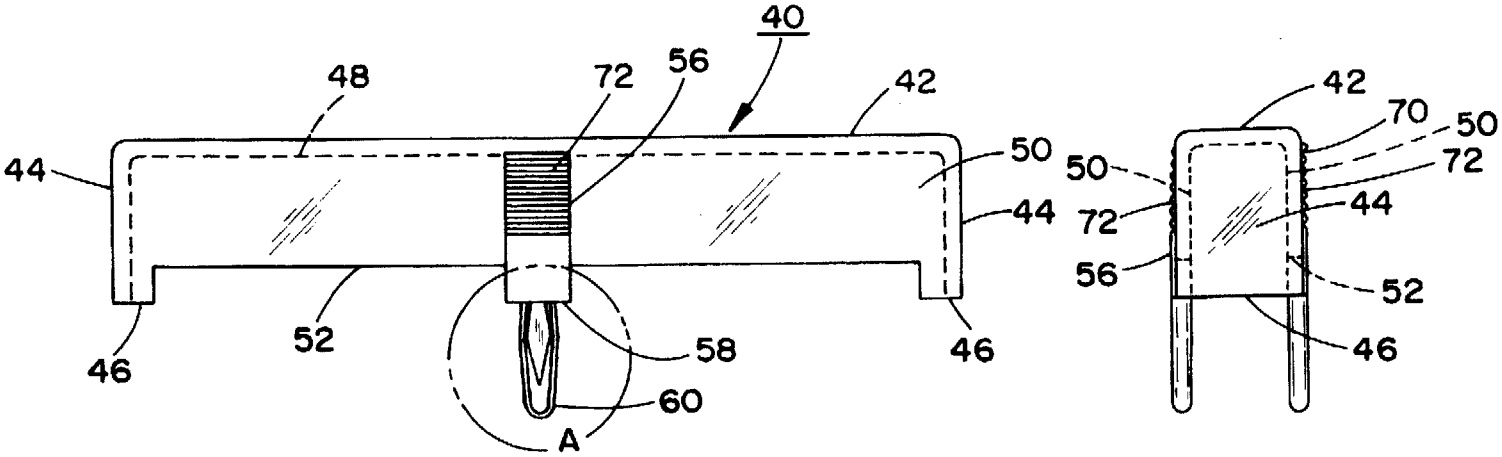
FIG.2
FIG.4
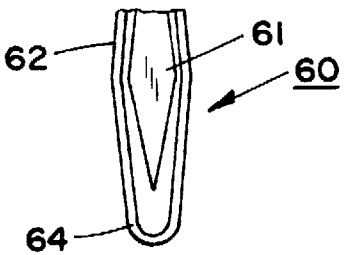
FIG.6
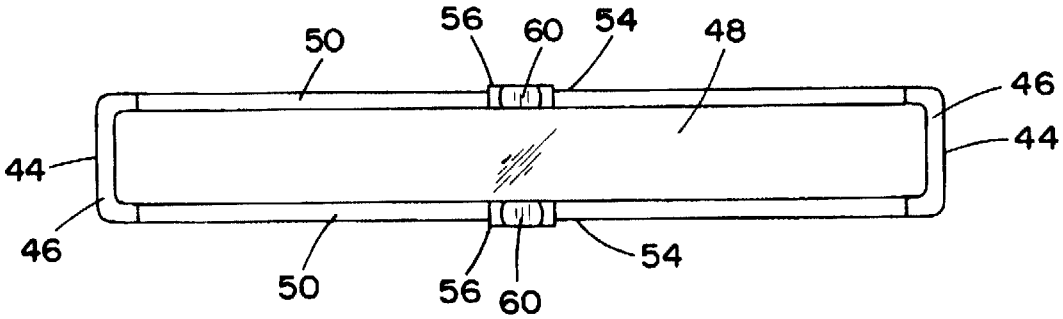
FIG.3
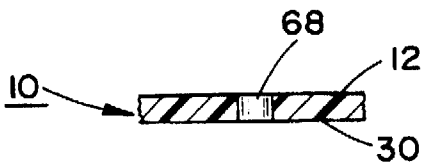
FIG.5

REMOVABLE COVER FOR WIRE WRAP CONNECTORS

BACKGROUND OF THE INVENTION

1. Field of the Invention

The present invention relates, in general, to a cover structure which is adapted to protect the contact pins of connectors which are installed, for example, in a printed circuit board of a mother board. More particularly, the invention is directed to the provision of a removable protective cover for wire wrap pins which are installed in the mother board so as to prevent these pins from bending and electrically shorting together and wherein the removability of the protective cover facilitates ready access to the wire wrap pins to enable installation of additional wire wraps in the field.

The utilization of protective covers for various types of electrical wire connection and contact pins is well known in the electrical technology, wherein such protective covers are, in some instances, employed to protect printed circuit board solder pads and other electrical components which may be located on a mother circuit board.

2. Discussion of the Prior Art

Testa et al. U.S. Pat. No. 5,488,539 discloses a typical mother circuit board for an electronics system having a plurality of electrical and electronics components mounted on each face of the circuit board. A protective cover which is of a substantially square perimetral configuration is equipped with separate anchor pins at two diagonally opposite corners thereof, and is adapted to be removably installed over a solder pad by being attached to the anchor pins which clampingly extend through anchoring apertures found in the circuit board. This enables the protective cover to extend over and protect the electrical components positioned therebeneath when the mother circuit board is passed through a conventional wave solder operation, and is thereafter removed.

Kandybowski U.S. Pat. No. 5,261,828 discloses an edge mounted connector assembly for a printed circuit board in which a housing structure is adapted to be positioned over electrical contact pins so as to prevent these from any potential misalignment and bending.

Norton et al. U.S. Pat. No. 4,808,115 discloses a connector assembly for printed circuit boards in which a housing structure is adapted to be positioned over upstanding connector pins. This, in essence, produces a cover arrangement affording some degree of protection to contact pins and other electrical elements, securing these from misalignment, bending and other undue external physical influences.

Although the foregoing patent publications all relate to various types of covering arrangements for electrical components, such as for solder pads on circuit boards or contact pins which may be mounted on and extend from printed circuit boards or various kinds of mother boards, these do not afford the versatility contemplated by the contact pin protective cover of the present invention.

SUMMARY OF THE INVENTION

Accordingly, pursuant to the present invention, pluralities of upstanding wire wrap pins of connectors which are mounted in specific arrays on circuit boards or mother boards are protected from bending and possible resultant electrical shorting, through the provision of a removable cover structure, constituted of a non-conductive, preferably rigid molded plastic material, which is readily mounted on the board in superimposed protective position over the plurality of arrayed wire wrap pins through the intermediary of integral anchoring legs clampingly extending through suitable anchoring apertures formed in the mother or circuit board, and whereby these covers are designed to specifically protect and encompass the wire wrap pins rather than extending over the entire mother or circuit board. This eliminates the need for having to remove a large protective cover which would expose all of the components on the board in order to gain access to external connecting elements adapted to mate with particular connectors on the printed circuit board; in effect, such covers upon removal from the printed circuit board or motherboard mounting the electrical components being removed only at specific locations to enable access to the particular array or pluralities of wire wrap pins of connectors installed therebeneath.

Accordingly, it is an object of the present invention to provide a protective cover structure for electrical connecting elements which are mounted on a mother board or circuit board.

A more specific object of the present invention resides in the provision of a protective cover structure for arrays of wire wrap pins which extend upwardly from the surface of a mother circuit board, and whereby the protective cover structure is easily removable from and replaceable over the pins as required.

Still another object of the present invention is to provide a protective cover structure for arrays of wire wrap pins which are mounted on a mother circuit board wherein the cover structure is of a unitary non-metallic or molded plastic construction.

BRIEF DESCRIPTION OF THE DRAWINGS

The foregoing and other objects of the invention may be more readily ascertained from the following detailed description of a preferred exemplary embodiment of a cover structure pursuant to the invention, taken in conjunction with the accompanying drawings in which:

FIG. 2 illustrates a side elevational view of the protective cover structure pursuant to the invention;

FIG. 3 illustrates a bottom view of the cover structure;

FIG. 4 illustrates an end view of the cover structure;

FIG. 5 illustrates a fragmentary portion of the circuit board, taken along line 5—5 in FIG. 1, showing an aperture adapted to clampingly receive an anchoring leg of t protective cover structure of FIG. 2; and FIG. 6 illustrates, on an enlarged scale, the encircled portion A in FIG. 2 showing the anchor leg in more specific detail.

DETAILED DESCRIPTION OF A PREFERRED EMBODIMENT

Figure 1:
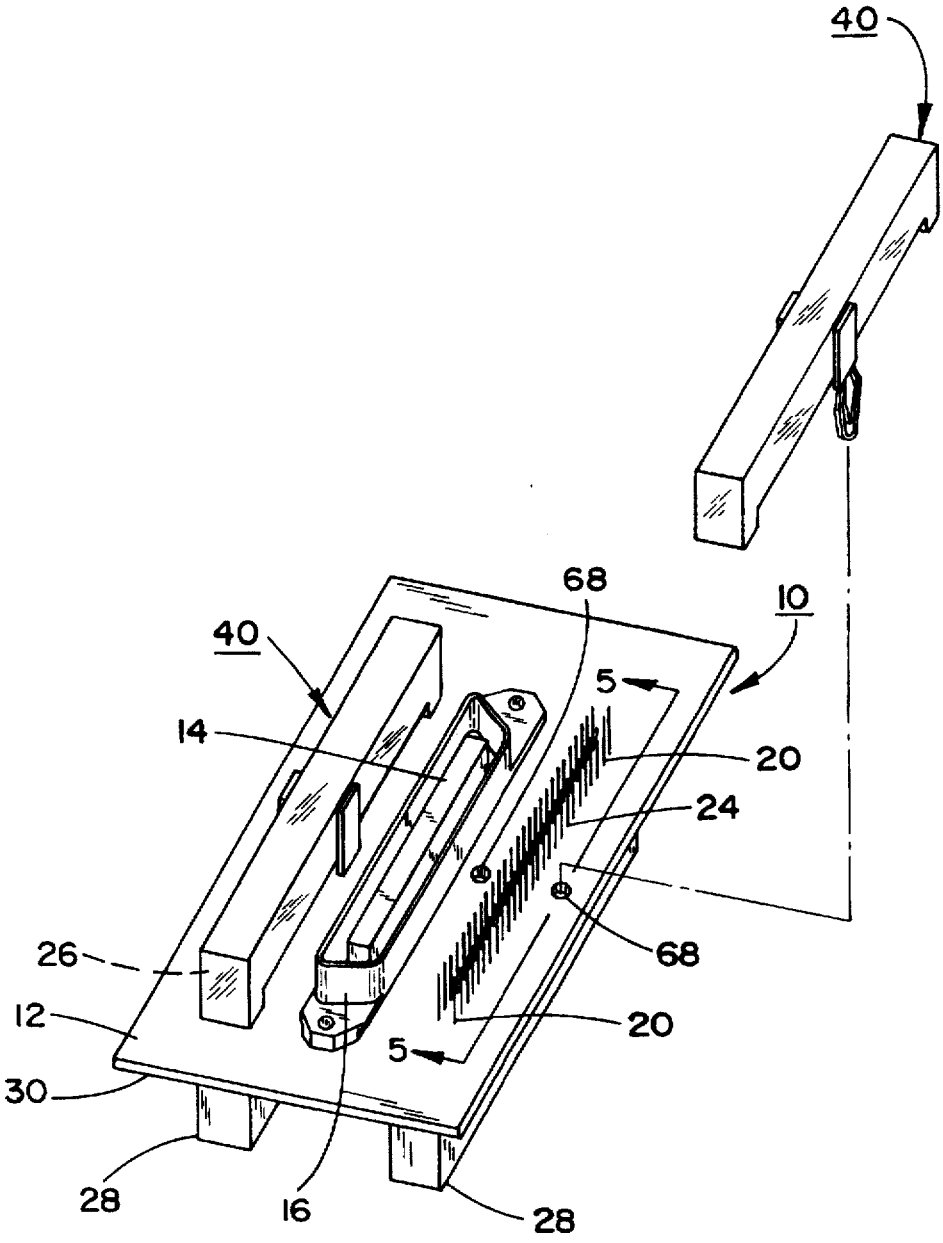
FIG. 1 illustrates an exploded generally diagrammatic perspective view of a portion of a mother circuit board having a plurality of arrays of upstanding wire wrap pins extending therefrom, with one of the inventive cover structures being shown superimposed protectively over one array of wire pins, whereas a second cover structure is illustrated in the removed condition thereof relative to a second array of wire wrap pins.

Referring specifically in detail to the drawings, particularly the exploded perspective view of FIG. 1, there is illustrated a portion of a mother circuit board 10, and which is constituted of a flat plate element of a non-conductive material, as is well known in the technology. In this instance, shown mounted on a surface 12 of the circuit board 10 is a connector unit 14, for example, a modular plug connector, having a plurality of contacts positioned on an elongate raised central structure 16 of the connector 14 to enable engagement with a suitable complementary connector (not shown).

Arranged spaced on opposite sides along the extent of the modular connector unit 14 are a plurality of upstanding wire wrap contact pins 20 of connectors, shown arranged in two elongate arrays 24, 26 each having two rows of contact pins 20. Housings 28 for the connectors are mounted on the opposite surface 30 of the mother circuit board 10, one such housing for each array of contact pins, with the upright pins projecting through the board surface 12 to extend perpendicularly upwardly thereof. As mentioned, in this case, provided are the two arrays 24, 26 of wire wrap contact pins 20, each array consisting of respectively two rows of twenty-six pins 20 located on opposite sides of the modular connector unit 14.

Inasmuch as the contact pins 20 are relatively delicate in nature and are easily inadvertently bent and electrically shorted, it is an important aspect to be able to protect these pins 20 by means of a suitable removable cover structure which does not necessarily encompass the entire surface of the mother board when it is desired to access different arrays of the contact pins 20. Thus, the cover arrangement is designed in the overall dimensioning thereof to only facilitate access to specific arrays of wire wrap contact pins 20.

In order to provide protection against possible inadvertent or accidental bending, breakage and/or electrical shorting of the respective wire wrap pins 20 for the different connectors in housings 28, each array 24, 26 of wire wrap contact pins 20 is equipped with a separate removable protective cover 40.

With specific reference to FIGS. 2 through 4 of the drawings, each protective cover 40 for each of the arrays 24, 26 of wire wrap contact pins 20 consists of an essentially hollow rectangular box-like structure which includes an upper elongate planar wall 42, end walls 44 depending from wall 42, which have lower edges 46 adapted to be supported on the surface 12 of the mother circuit board 10 when positioned over a respective array 24 or 26 of wire wrap contact pins 20, and wherein the height of the end walls 44 is such as to maintain the inner surface 48 of wall 42 at a distance above the upper ends of pins 20.

Sidewalls 50 depend from planar wall 42 along each side edge thereof to extend between the end walls 44 spaced along the length of the applicable wire pin array 24 or 26, with the sidewalls 50 having lower edge portions 52 which are recessed or raised from the surface 12 of the mother circuit board 10, to possibly enable a flow of cooling air to circulate about the contact pins 20 when required. Centrally formed on the outer surfaces 54 of each sidewall 50 intermediate the end walls 44, and depending downwardly is an integrally molded flange member 56, the lower edges 58 of which are in a plane which is coextensive with the lower edges 46 of the end walls 44 so as to be firmly supported on the surface 12 of the mother circuit board 10 when positioned over the arrays of wire wrap pins 20. Extending downwardly from each flange member 56 is a resiliently flexible anchor leg 60 which possesses an outwardly bowed, diamond-shaped configuration in the plane of the flange member 58; and which incorporates a central cutout 61, so as to enable each anchor leg portion 62, 64 to be inwardly deformable towards each other and resiliently radially outwardly expandable to a certain extent, as shown in FIG. 6 of the drawings. Each of these downwardly depending anchor legs 60, upon the protective cover structure 10 being positioned on the surface 12 of the mother circuit board 10 over an array 24 or 26 of wire wrap contact pins 20 is adapted to be pushed through an aperture or hole 68 formed in the mother board 10, each aperture being located adjacent the outer longitudinal sides of the respective array 24 or 26 of wire wrap pins 20, the apertures 68 being spaced apart in conformance with the spacing of the opposite flange members 56 and anchor legs 60 of the cover structure, and with each aperture 68 being dimensioned so as to be slightly smaller in diameter than the maximum width of the expanded leg portions 62, 64 of the anchor leg 60. Thus, upon each anchor leg 60 being pushed downwardly (or pulled up) though the therewith associated aperture 68 in the mother circuit board 10, the resiliently compressible or expandable leg portions 62, 64 thereof are compressed to enable passage therethrough, and upon having passed through the hole downwardly while the lower edges 46, 58 of the wall and flange members are supported on the surface 12 of the mother circuit board 10, will resiliently expand so as to form a clamping engagement in position beneath the lower surface 30 of the board, retaining the protective cover structure 40 in position over the wire wrap pins.

The outer surface 70 of each of the two flange members 56 which are formed on the respective sidewalls 50 of the protective cover structure 40, and which extend downwardly into the anchor legs 60 is provided with horizontal or transverse grooves or serrations 72 which facilitate the gripping of the cover structure and the manipulation thereof so as to either place or remove the cover structure into or from its location over the wire wrap pins 20. The upward displacement and removal is, of course, facilitated in that when a sufficient pull is exerted on the cover structure 40, the outwardly expanded leg portions 62, 64 of each of the anchor legs 60 will deflect inwardly towards each other so as to enable passage through the aperture 68 in the circuit board, and thereafter to expand again after having passed through the mother circuit board. This same sequence is also applicable in reverse order during the mounting of the cover structure 40 on the board 10.

Preferably, although not necessarily, the cover structure 40 is constituted of a suitable non-metallic material, such as a molded plastic material; for instance, a clear or transparent polycarbonate, which may be commercially sold under the Trademark "Lexan 940", although other materials may be equally satisfactory in providing the protective cover structure for the wire wrap pins.

From the foregoing it becomes readily apparent that the protective cover 40 for the wire wrap pins 20 is of an extremely simple and inexpensive construction; essentially constituted of a unitarily molded plastic material which, when clear or transparent in nature, not only provides an adequate protective covering but also affords visual inspection of the respective arrays 24 or 26 of wire wrap contact pins 20 or connectors which are located therebeneath.

Although the invention is described in connection with forming a protective cover for wire wrap pins or the like, it may become readily apparent to one skilled in the art that the protective cover structure may be employed for protectively enclosing other electrical contacts and/or components which are mounted on different kinds of boards or supportive substrates.

While there has been shown and described what is considered to be a preferred embodiment of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A protective cover structure for a plurality of electrical contact elements mounted on and extending upwardly from a support plate, said cover structure comprising a planar wall member having a generally rectangular, configuration, end walls depending from opposite ends of said planar wall member, sidewalls depending from opposite sides of said planar wall member and extending between said opposite end walls to form a box-shaped structure having a lower open side so as to receive said electrical contact elements therein upon said cover structure being supported on said support plate, depending anchor legs extending downwardly from each of said sidewalls for attaching said cover structure to said support plate, each said sidewall including an external plate member located centrally intermediate the opposite ends thereof, said plate member depending downwardly and terminating in a lower edge which is coplanar with a lower edge of each said end wall so as to be positioned on said support plate, said anchor legs each depending from the lower edge of respectively each said plate member, each said anchor leg comprising a resiliently expandable and compressible hollow diamond-shaped element, wherein each said anchor leg is passable through an aperture in said support plate for clampingly engaging a lower surface of said support plate upon said cover structure being mounted thereon.

2. A protective cover structure as claimed in claim 1, wherein said end walls include lower edge surfaces for supporting said cover structure on said support plate, said end walls having a height and said planar wall member having peripheral dimensions whereby said electrical contact elements are in spaced relationship with the internal wall surfaces of said cover structure.

3. A protective cover structure as claimed in claim 1, wherein said sidewalls each include raised lower edge portions forming a space with said support plate upon said cover structure being positioned thereon.

4. A protective cover structure as claimed in claim 1, wherein each said plate member includes an outer surface having transversely extending grooves formed therein to facilitate gripping manipulative engagement of said cover structure.

5. A protective cover structure as claimed in claim 1, wherein said cover structure is constituted of a unitary molded plastic material.

6. A protective cover structure as claimed in claim 5, wherein said plastic material is essentially transparent.

7. A protective cover structure as claimed in claim 5, wherein said plastic material comprises a polycarbonate.

8. A protective cover structure as claimed in claim 1, wherein said cover structure is detachably fastened to said support plate upon superposition over said plurality of electrical contact elements.

* * * * *